United States Patent [19]

Klein et al.

[11] Patent Number: 4,795,042

[45] Date of Patent: Jan. 3, 1989

[54] SPLIT BACK MAIL SORTER

[75] Inventors: Harold S. Klein, Wayzata; Marcus S. Lehman, Lake City, both of Minn.

[73] Assignee: Liberty Diversified Industries, New Hope, Minn.

[21] Appl. No.: 72,800

[22] Filed: Jul. 13, 1987

[51] Int. Cl.[4] ..... A47F 5/00

[52] U.S. Cl. ..... 211/186; 108/111; 211/10; 211/135

[58] Field of Search ..... 211/135, 154, 10, 187; 108/111, 61

[56] References Cited

U.S. PATENT DOCUMENTS

| | | | |
|---|---|---|---|
| 3,269,788 | 8/1966 | Kneer | 211/10 X |
| 3,737,046 | 6/1973 | Jeter | 211/10 |
| 3,807,572 | 4/1974 | Luvava et al. | 211/10 |
| 4,193,650 | 3/1980 | Gray et al. | 108/61 X |
| 4,208,818 | 6/1980 | Butcher | 211/184 X |
| 4,503,982 | 3/1985 | Lewis | 211/135 X |
| 4,664,040 | 5/1987 | Levenberg | 211/135 X |

FOREIGN PATENT DOCUMENTS

| | | | |
|---|---|---|---|
| 627954 | 9/1961 | Canada | 211/10 |

*Primary Examiner*—Robert W. Gibson, Jr.
*Attorney, Agent, or Firm*—Moore & Hansen

[57] ABSTRACT

A mail sorting apparatus having a pair of opposing side panels, a top panel, a pair of opposing back panels, and a plurality of shelving members extending between the opposing side panels. The shelving members are supported by brackets having spaced apart shelf supporting tabs, the brackets being located along the opposing side panels and back panels. The shelving members are divided into compartments by a plurality of dividers, with the dividers being received within slots extending through the shelving members. The size of the compartments is adjustable by modifying the spacing of the shelving members and placement of the dividers.

15 Claims, 2 Drawing Sheets

SPLIT BACK MAIL SORTER

BACKGROUND OF THE INVENTION

This invention relates generally to articles of office furniture used for organizing or distributing correspondence and communications, and particularly to an improvement in such an article commonly referred to as a desktop mail sorting rack.

Mail sorting stations are found in many business and office settings, and the designs for mail sorting racks are well known to the art. Most conventional mail sorting racks comprise a series of horizontal shelves which are divided into compartments by vertical partitions. Examples of such mail sorting racks are shown in U.S. Pat. Nos. 4,062,302 and 3,107,012.

All of the compartments in a given mail sorting rack are generally of the same invariable dimensions, such that a person must choose the particular size and the total number of compartments at the time the mail sorter is being ordered or purchased. If the needs of the business change, one or more additional mail sorters must be acquired or the existing mail sorters must be completely replaced. In either case, this can represent a significant expense. If the business chooses to make do with the existing sorters even though they have been rendered obsolete or inappropriate, the result can often be inconvenience to those using the mail sorting system, and lost or inefficient communications within the business. While some mail sorting racks permit the vertical partitions to be removed, the heights of the individual compartments are not adjustable, and the partitions are not designed to function with compartments which would be adjustable.

The more familiar mail sorting racks and apparatuses include freestanding or tabletop shelving units constructed of textured sheet metal or fiberboard, having permanently fixed fiberboard or plastic partitions. Recently, mail sorting stations have been introduced to the market which comprise individual plastic or plastic-coated wire mesh partitions and shelves which permit an individual to see further into each compartment, or view a document through the shelf above.

In situations where only a very few compartments are required, multi-tiered trays and wall mounted organizers have proven to be suitable, as have filing stands with upright vertical dividers. An example of a simple, two-tiered desktop mail tray is shown in U.S. Pat. No. D. 212,264. Mail sorting trays and racks having more complex arrangements of shelves or baskets are also known. These items are generally constructed from high impact plastic or a generally rigid sheet metal.

One particular design includes individual, interconnected molded plastic organizers commonly referred to as "hot files." Hot files have the general shape of an inverted, open top triangular prism, and are usually mounted directly to a wall or floor stand in a vertically overlapping, tiered configuration similar to that of a magazine rack.

For infrequent or occasional use in sorting or distributing correspondence, a collating apparatus comprising a series of extensible slanted metal loop partitions connected in an accordion fashion may be employed. Such a collating apparatus is disclosed in U.S. Pat. No. 2,310,770.

Another item which may function as a mail sorting station is the desktop hutch organizer. These desktop organizer stands usually have a depth of one foot or less and a width approximately equal to the length of a standard secretarial desk, such that the organizer may rest on top of a desk and against a wall. These hutch type organizers generally have several shallow compartments and bookend type dividers.

A product similar to the conventional mail sorter and often found in the same business or office settings is the literature center or literature organizer. These items are more often used to store product information sheets, brochures, catalogs, and the like, where they may be easily accessed by employees for distribution or reference. The literature centers or literature organizers may also be adapted for use in mail sorting and distribution.

It should be noted, however, that the typical mail sorters are very large in overall size, particularly those which are designed to be freestanding or tabletop racks. This is also true for products such as the literature centers and desktop hutch organizers. While some of these items may be partially assembled by the purchaser, they will generally have some preassembled substructures such as the partitions and shelves, particularly if welding or crimping of rigid metal components is required.

Fiberboard or corrugated cardboard mail sorting devices may be broken down or disassembled, but are generally much lighter in weight than their steel or steel and plastic counterparts, and are correspondingly less durable or able to withstand the rigorous handling and use of an office environment.

Many of the mail sorters or products which may be adapted to use as mail sorters are thus bulky and generally difficult to ship to the customer. The ability to ship a product via standard non-freight carrier, such as the United Parcel Service, provides many advantages to catalog and mail order houses. Because the non-freight services deliver rapidly, and at a competitive rate, the shipper does not have to support and manage its own delivery system, nor choose between the additional expenses of a specialized package delivery service for short-range deliveries, additional charges for oversized non-freight deliveries by standard carriers, or have its customers inconvenienced and lose prospective sales due to the extended delay created by conventional freight carriers.

The individual or add-on type systems such as the hot files do not use office space efficiently, and have a very limited capacity. Trays and stacking organizers similarly cannot be accumulated in sufficient numbers to be practical in most offices without being unstable, unsightly, and inconvenient. The upright, open top dividers which are similar to a row of bookends and in which papers are set on edge do not hold looseleaf correspondence well, allow the edges to be crimped or curled, permit papers to slide out of the slots thus becoming disorganized, and may often result in misplaced correspondence when end pages in a stack are not placed between the proper dividers.

The uniform and invariable sizes of standard mail sorters limit their flexibility, since a person cannot choose to have various compartments of different sizes without purchasing two different mail sorting stations. A person cannot progressively or incrementally increase the number of compartments as the business organization grows or the communications network changes, nor vary the size of the compartments or decrease the number of compartments when appropriate.

BRIEF SUMMARY OF THE INVENTION

It is therefore one object of this invention to design a mail sorting apparatus which provides the user with an array of selectable compartment sizes and numbers.

It is a related object of this invention to design the above mail sorting apparatus such that the user may modify or readjust the sizes and numbers of compartments as may occasionally be required.

It is another object of this invention to design the above mail sorting apparatus such that it may be completely disassembled and shipped in a standard packaging carton by a non-freight carrier, and assembled by the purchaser using a minimum of tools and non-permanent fasteners.

It is an additional object of this invention to design the above mail sorting apparatus such that it may be utilized as a wall mounted unit or positioned on a table or desktop, while retaining usable work space below the mail sorting apparatus for performing related tasks or placing and operating office equipment.

It is a further object of this invention to design the above mail sorting apparatus such that it will conform to the general type and style of furniture and equipment found within a business or office setting.

Briefly described, the main sorting apparatuss of this invention is comprised of a pair of opposing side panels, a top panel, a pair of opposing back panels, and a plurality of shelving members extending between theh opposing side panels. The shelving members are supported by brackets having spaced apart shelf supporting tabs, the brackets being located along the opposing side panels and back panels. The height of the shelving members may thus be adjusted using the brackets and shelf support tabs. One of back panels includes an angluarly offset lip which receives the adjacent straight edge of the remaining back panel. The back panels and side panels are connected by locking tabs which are received in corresponding aligned slots and bent to hold the back panels and side panels together.

The shelving members are divided into compartments by a plurality of dividers, each divider having a series of alternating notches extending inwardly from the front and back edges thereof, with the dividers being received within slots extending through the shelving members, and secured in place by locking a portion of the shelving members within the notches.

DESCRIPTION OF THE PREFERRED EMBODIMENT

The split back mail sorter of this invention is shown in FIGS. 1–6 and referenced generally therein by the numeral 10.

The mail sorter 10 may be constructed from any heavy gauge sheet metal with a textured or painted enamel finish, or in suitable applications from wood, pressboard, or plastic resin. Various components of the mail sorter 10 may be constructed of different materials depending upon the desired aesthetic design or ornamentation, and the cost of producing the mail sorter 10. The mail sorter 10 is designed to be rested upon a supporting surface such as a table or desk (not shown), although it may be made of suitable dimensions to be freestanding on the floor, or mounted in a hanging configuration from a vertical wall or partition.

Figure 1:
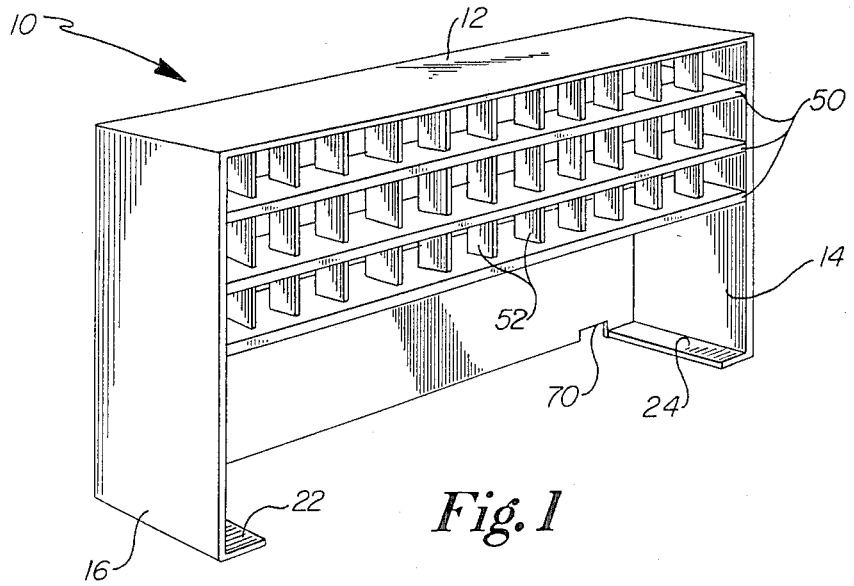
FIG. 1 is a perspective view of the mail sorting apparatus of this invention in an upright, assembled configuration.

Referring to FIG. 1, it may be seen that the split back mail sorter 10 is comprised of a top panel 12 which extends the full length of the mail sorter 10, a pair of generally upright opposing side panels 14, 16 at each end of the mail sorter 10, and a pair of back panels 18, 20 which similarly extend the full length of the mail sorter 10 and together combine to extend the full height of the side panels 14, 16 of the mail sorter 10.

The side panels 14, 16 extend downwardly from and generally perpendicular to each end of the top panel 12, with the back panels 18, 20 extending between the rear edges of the side panels 14, 16 generally perpendicular thereto, and similarly perpendicular to the top panel 12.

Each side panel 14, 16 has a base panel 22, 24 which projects inwardly a short distance from the bottom edge of each of the side panels 16, 14 respectively, and is oriented generally perpendicular to the side panels 16, 14 and the back panels 18, 20, and parallel to the top panel 12.

The back panels 18, 20 each have a generally straight top edge 26, 28 which extends the full length of each panel 18, 20. The upper back panel 18 has an inwardly projecting angled segment 30 and a downwardly depending lower edge 32 defining a generally S-shaped lower lip. The curved segment 30 projectes inwardly a distance equal to or slightly greater than the thickness of the top edge 28 of the lower back panel 20 such that the top edge 28 of the lower back panel 20 may be received behind the lower edge 32 and beneath the inwardly projecting segment 30, with the segment 30 and the upper back panel 18 resting upon the top edge 28 of the lower back panel 20 as particularly shown in FIG. 3. The lower edge 34 of the lower back panel 20 projects inwardly at right angle to form a supporting base.

Figure 2:
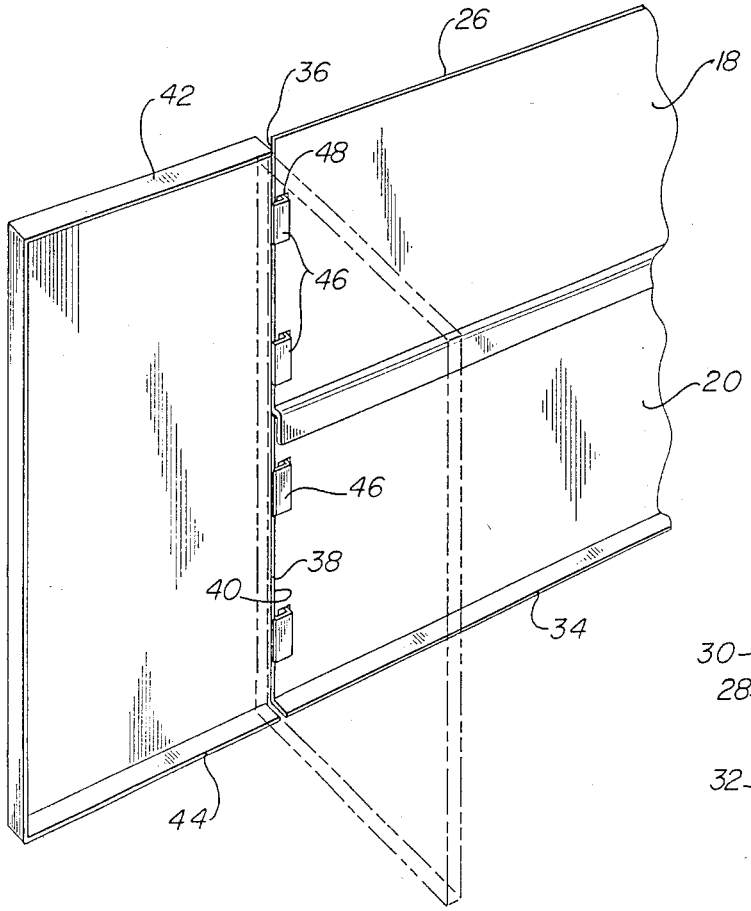
FIG. 2 is a perspective view showing the assembly step of mounting the top and bottom back panels to a side panel of the mail sorting apparatus of FIG. 1.
Figure 3:
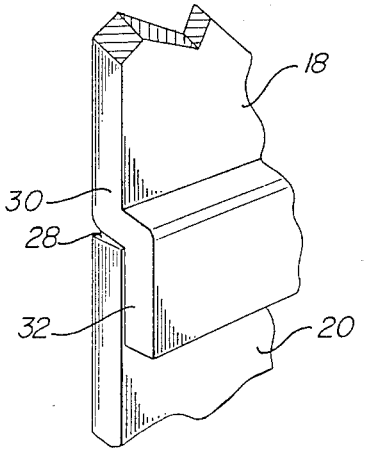
FIG. 3 is an enlarged perspective view of the abutting edges of the top and bottom back panels of the mail sorting apparatus of FIG. 1.
Figure 4:
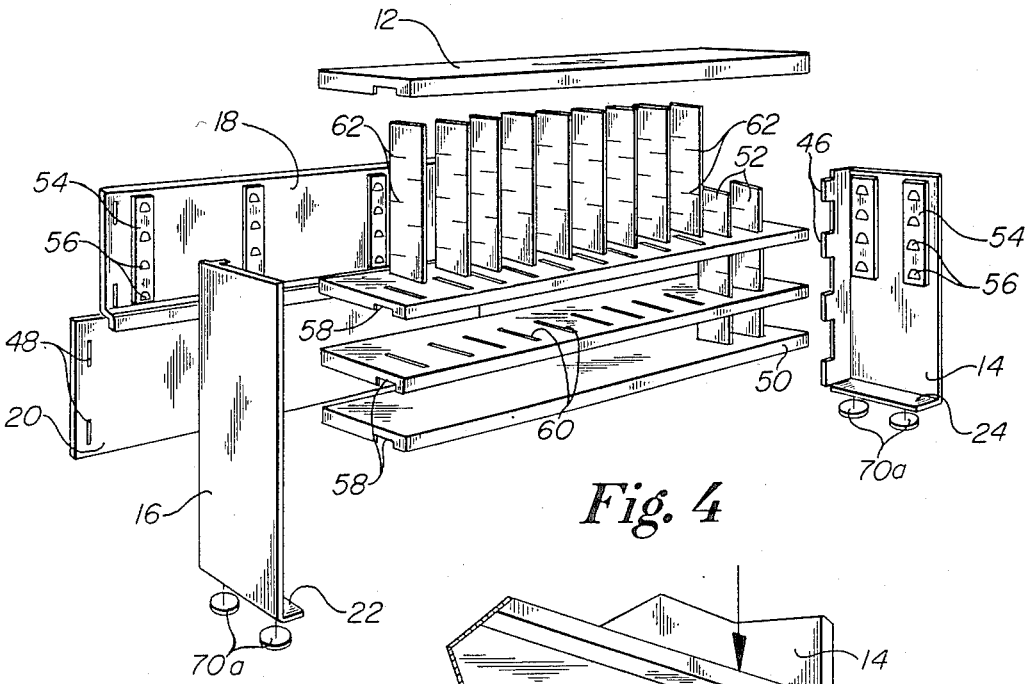
FIG. 4 is a partially exploded perspective view of the mail sorting apparatus of FIG. 1.

Referring to FIG. 2, it may be seen that each side panel 14, 16 is attached to each of the back panels 18, 20 along the back edges 40 of each side panel 14, 16 and the end edges 36, 38 of the back panels 18, 20. Extending from each of the back edges 40 of the side panels 14, 16 between the top edge 42 and bottom edge 44 thereof are a plurality of locking tabs 46. The locking tabs 46 are vertically spaced a distance apart and are received within aligned rectangular slotted apertures 48 correspondingly located on the upper 18 or lower back panel 20. The locking tabs 46 may initially be L-shaped such that the tabs 46 project forward toward the front of the mail sorter 10, or may be made of a semi-flexible material which is bent at a right angle once the locking tabs 46 have been inserted through the slotted apertures 48.

The preferred number of locking tabs 46 and apertures 48 is four, with two apertures 48 and locking tabs 46 corresponding to each of the back panels 18, 20. The locking tabs 46 are inserted straight through the apertures 48 while the side panel 14, 16 is oriented in a plane generally parallel to the back panels 18, 20, with the bottom back panel 20 receiving the locking tabs 46 first so that the bottom edge 32 of the upper back panel 18 may be placed in overlapping and engaging contact with the upper edge 28 of the lower back panel 20 as described above. The side panels 14, 16 are then pivoted forward approximately ninety degrees tp the upright position generally perpendicular to the back panels 18, 20. The locking tabs 46 may be manually bent to secure them within the apertures 48, or may be designed to be bent by the pivoting action of the side panels 14, 16. The top edge 42 and bottom edge 44 of each side panel 14, 16 may project inwardly at a right angle simolar to the bottom edge 34 of the lower back panel 20, in which case the edges 34, 44 should be made to overlap, or beveled (not shown) to prevent the bottom edges 34, 44 from interfering and yet permit each to rest on a supporting surface.

Referring again to FIG. 1, it may be seen that the mail sorter 10 also comprises a plurality of horizontal shelves 50 and vertical dividers 52 extending between the shelves 50 and forming a series of compartments.

Each shelf 50 is mounted on shelf brackets 54 which are attached to the side panels 14, 16 and back panels 18, 20. While the side panels 14, 16 give support to the back panels 18, 20, the brackets 54 may be made to extend between the back panels 18, 20 and further provide additonal support, particularly if the brackets 54 are to be attached to the back panels 18, 20 by the person completely assembling the mail sorter 10. It is preferable that a pair of brackets 54 be placed on each side panel 14, 16 near the front and back edges of each shelf 50, and at least four brackets 54 spaced apart on the back panels 18, 20 along the rear edge of the shelves 50.

Figure 5:
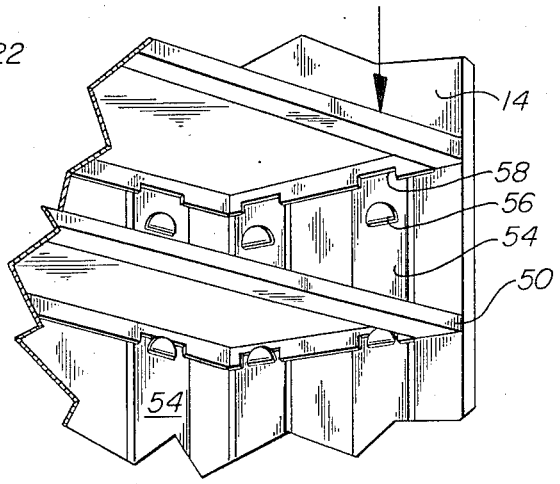
FIG. 5 is an enlarged perspective view showing the assembly of the brackets and shelves of the mail sorting apparatus of FIG. 1.

Referring to FIG. 5, it is shown that each bracket 54 includes a number of shelf support tabs 56 which project upwardly and are displaced a slight distance from the bracket 54 and which engage locking grooves 58 along the bottom edge of each shelf 50. The shelves 50 may thus be selectively mounted at varying heights along the bracket 54 depending upon the spacing of the shelf support tabs 56 to provide for different distances between the shelves 50.

Each shelf 50 also defines a series of slots 60 extending between and generally perpendicular to the front and back edges of the shelf 50 through which the dividers 52 are inserted. Each divider 52 has a plurality of locking notches 62 positioned along each vertical edge of the divider 52 and spaced at vertical intervals corresponding to the spacing between the shelf support tabs 56 on the brackets 54. The notches 62 extend inwardly from the front and back edges of the divider 52 and are spaced apart in an alternating pattern relative to one end edge of the divider 52.

Figure 6:
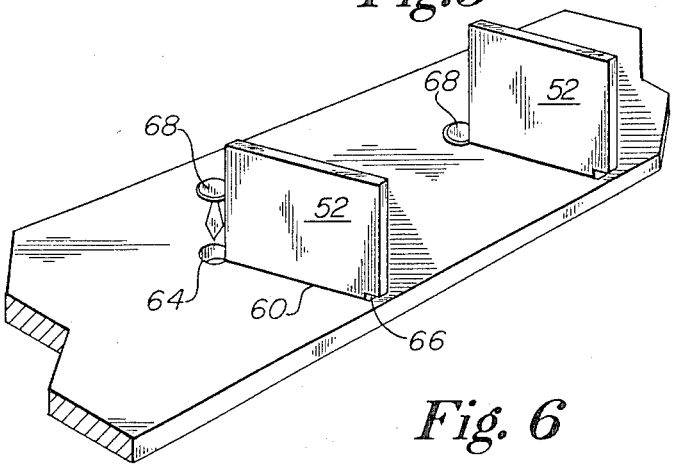
FIG. 6 is an enlarged perspective view showing the assembly of the dividers and shelves of the mail sorting apparatus of FIG. 1.

Referring to FIG. 6, it may be seen that the slots 60 each define a circular aperture 64 at the rear end of each slot 60 such that each divider 52 may be received within the slot 60 and pressed forward to engage the locking notch 62 into contact with the front edge 66 of the slot 60, and a push fastener 68 inserted into the aperture 64 to retain the divider 52 in that position.

By selecting varying heights for the shelves 50 defined by the positions of the shelf support tabs 56, and selecting the appropriately spaced and alternately positioned locking notch 62 in each divider 52, a variety of compartment sizes may be selected by the person assembling the mail sorter 10.

The bottom edge 34 of the lower panel 20 may optionally define an access portal 70 through which cords may be passed such that when the mail sorter 10 is placed on a table top or similar support, various electronic office equipment such as a postage meter or three-hole punch may be placed in the region below the shelves 50. Towards this end, it is preferable for the mail sorter 10 to have a plurality of foam rubber cushions **70*a* attached to the bottom edges 22, 24 and 34 of the lower back panel 20 and side panels 14, 16 to prevent the mail sorter 10 from sliding on or scratching the surface of a table or stand, and further that the mail sorter 10 define an ample open region 74 beneath the lowest shelf 50** to accommodate various associated office equipment or to provide a utility work space.

While the preferred embodiment of the present invention has been described, it should be understood that various changes, adaptations, and modifications may be made therein without departing from the spirit of the invention and the scope of the appended claims:

What is claimed is:

1. A mail sorting apparatus comprising:

a pair of opposing side panels, each said side panel having a top edge and a back edge and being oriented in a generally vertical position;

a top panel extending generally horizontally between and connected to each of said opposing side panels along the top edges thereof;

a first back panel and a second back panel, each said back panel extending between and connected to the opposing side panels along the back edges thereof;

a plurality of shelving members, said shelving members extending generally horizontally between and being mounted to the opposing side panels;

a plurality of generally vertical dividers, each said divider being mountable on at least one said shelving member and extending between said shelving member to which said divider is mounted and an adjacent shelving member or said top panel so as to divide said shelving members into a plurality of compartments, each said divider having a pair of opposing front and back edges and a plurality of notches extending inwardly from at least one of said front or back edges of said divider, the shelving members further defining a plurality of slots extending entirely through the surface of the shelving members, said slots having a width greater than the thickness of said dividers and said notches further having a width greater than the thickness of the shelving members, such that a portion of said dividers may be slidably and removably received within said slots of the shelving members in a generally vertical position, and further such that a portion of each of the shelving members receiving said dividers may be slidably and removably received within said notches of said dividers; and means for fastening the dividers to the shelving members.

2. The mail sorting apparatus of claim 1 wherein the slot has a pair of opposing ends and further defines at least one aperture communicating with one end of the slot, and wherein the means for fastening the dividers to the shelving means comprises:

a locking tab, said locking tab being slidably received within the aperture adjacent one of the front or back edges of the divider after the portion of the divider is received within the slot and the portion of the shelving member is received within the notch.

3. The mail sorting apparatus of claim 2 wherein the aperture has a diameter and the notch has depth which is approximately equal to said diameter of the aperture.

4. The mail sorting apparatus of claim 1 wherein the notches extend inwardly from the front and back edges of the divider.

5. The mail sorting apparatus of claim 4 wherein the divider has an end edge and the notches extend inwardly from the front and back edges of the divider in an alternating spaced apart pattern relative to said end edge.

6. The mail sorting apparatus of claim 1 further comprising: connecting means for connecting the first and second back panels to the side panels, said connecting means including a plurality of locking tabs, each said locking tab extending from and connected to the opposing side panels adjacent the back edge thereof, each said locking tab having a width and a thickness, and each of the first and second back panels further defining a plurality of slot apertures at opposing ends thereof, each slot aperture having a width and a length, said length of said slot apertures being greater than the width of the locking tabs and said width of said slot apertures being greater than said thickness of said locking tabs such that said locking tabs of the opposing side panels may be slidably received within a corresponding aligned slot aperture when the side panels and first and second back panels are generally coplanar, with said side panels being pivoted to a position generally perpendicular to the first and second back panels.

7. The mail sorting apparatus of claim 6 wherein the side panels are secured to the back panels by bending a portion of each of the locking tabs which are slidably received within the slot apertures.

8. The mail sorting apparatus of claim 1 wherein the first back panel has a lower edge defining an angled portion and a lip portion depending from said angled portion, and the second back panel has a top edge and a planar surface adjacent and generally perpendicular to said top edge, such that the top edge of the second back panel is positioned adjacent to and in contact with the angled portion of the lower edge of the first back panel, and such that the depending lip portion of the first back panel is in overlying abutting contact with the surface of the second back panel, when the first panel is mounted vertically above the second back panel.

9. The mail sorting apparatus of claim 1 further comprising:

shelf mounting means for mounting the shelving members to the opposing side panels, said shelf mounting means including a plurality of brackets, each said bracket having a length and being attached to one of the opposing side panels with said length being oriented in a generally vertical direction of extent, each said bracket having a plurality of upwardly projecting shelf support tabs extending from and connected thereto in spaced apart relation along said length of said bracket, each said shelf support tab having a portion spaced a distance apart from said bracket such that said portion carries and supports a portion of one of the shelving members.

10. The mail sorting apparatus of claim 1 further comprising:

shelf mounting means for mounting the shelving members to the first and second back panels, said shelf mounting means including a plurality of brackets, each said bracket having a length and being attached to one of the first or second back panels with said length being oriented in a generally vertical direction of extent, each said bracket having a plurality of upwardly projecting shelf support tabs extending from and connected thereto in spaced apart relation along said length of said bracket, each said shelf support tab having a portion spaced a distance apart from said bracket such that said portion carries and supports a portion of one of the shelving members.

11. The mail sorting apparatus of claim 1 wherein the second back panel has a bottom edge, said bottom edge defining and access portal extending entirely through the surface thereof.

12. A mail sorting apparatus assembly comprising:

a pair of opposing side panels, each said side panel having a top edge and a back edge;

a top panel, said top panel having a pair of opposing ends, each opposing end being attachable to one of said top edges of said opposing side panels so as to extend generally horizontally therebetween;

a first back panel and a second back panel, said first and second back panels each having a pair of opposing ends, said opposing ends of said first and second back panels each being attachable to one of said back edges of said side panels so as to extend generally horizontally therebetween;

a plurality of shelving members, each said shelving member having a pair of opposing ends, each said shelving member being removably mountable to said opposing side panels so as to extend generally horizontally therebetween;

a plurality of generally vertical dividers, each said divider being mountable on at least one said shelving member and extending between said shelving member to which said divider is mounted and an adjacent shelving member or said top panel so as to divide said shelving members into a plurality of compartments, each said divider having a pair of opposing front and back edges and a plurality of notches extending inwardly from at least one of said front or back edges of said divider, the shelving members further defining a plurality of slots extending entirely through the surface of the shelving members, said slots having a width greater than the thickness of said dividers and said notches further having a width greater than the thickness of the shelving members, such that a portion of said dividers may be slidably and removably received within said slots of the shelving members in a generally vertical position, and further such that a portion of each of the shelving members receiving said dividers may be slidably and removably received within said notches of said dividers;

means for fastening the dividers to the shelving members;

means for fastening the shelving members to the opposing side panels; and means for fastening the first and second back panels to the opposing side panels.

13. A mail sorting apparatus assembly comprising:

a pair of opposing side panels, each said side panel having a top edge and a back edge;

a top panel, said top panel having a pair of opposing ends, each opposing end being attachable to one of said top edges of said opposing side panels so as to extend generally horizontally therebetween;

a first back panel and a second back panel, said first and second back panels each being attachable to one of said first and second back panels so as to extend generally horizontally between said opposing side panels;

a plurality of shelving members, each said shelving member having a pair of opposing ends, each said shelving member being removably mountable to said opposing side panels so as to extend generally horizontally therebetween;

a plurality of generally vertical dividers, each said divider being mountable on at least one said shelving member and extending between said shelving member to which said divider is mounted and an adjacent shelving member or said top panel so as to divide said shelving members into a plurality of compartments, each said divider having a pair of opposing front and back edges and a plurality of notches extending inwardly from at least one of said front or back edges of said divider, the shelving members further defining a plurality of slots extending entirely through the surface of the shelving members, said slots having a width greater than the thickness of said dividers and said notches further having a width greater than the thickness of the shelving members, such that a portion of said dividers may be slidably and removably received within said slots of the shelving members in a generally vertical position, and further such that a portion of each of the shelving members receiving said dividers may be slidably and removably received within said notches of said dividers;

means for fastening the dividers to the shelving members;

means for fastening the shelving members to the opposing side panels; and means for fastening the first and second back panels to the opposing side panels.

14. A mail sorting apparatus comprising:

a pair of opposing side panels, each said side panel having a top edge and a back edge and being oriented in a generally vertical position;

at least one back panel, each said back panel extending between and connected to the opposing side panels along the back edges thereof;

a plurality of shelving members, said shelving members extending generally horizontally between and being mounted to the opposing side panels;

a plurality of generally vertical dividers, each said divider having a thickness and being mountable on at least one said shelving member and extending between and being removably connected to said shelving member to which said divider is mounted and an adjacent shelving member so as to divide said shelving members into a plurality of compartments, said shelving member defining a plurality of slots extending entirely through the surface of the shelving member, said slots having a width greater than said thickness of said dividers, each said divider having a front edge and a back edge and defining at least one notch extending inwardly from at least one of said front or back edges of said divider such that a portion of said dividers may be slidably and removably received within said slots of the shelving member in a generally vertical position and further such that a portion of the shelving member receiving said divider may be slidably and removably received within said notch of said divider; and means for fastening the dividers to the shelving members.

15. A mail sorting apparatus comprising:

a pair of opposing side panels;

at least one back panel, each said back panel extending between and connected to the opposing side panels;

a plurality of shelving members, said shelving members extending generally horizontally between and being mounted to the opposing side panels;

a plurality of generally vertical dividers, each said divider having a thickness and being mountable on at least one said shelving member so as to divide said shelving member into a plurality of compartments, said shelving member defining a plurality of slots extending entirely through the surface of the shelving member, said slots having a width greater than said thickness of said dividers, each said divider having a front edge and a back edge and defining at least one notch extending inwardly from at least one of said front or back edges of said divider such that a portion of said dividers may be slidably and removably received within said slots of the shelving member in a generally vertical position and further such that a portion of the shelving member receiving said divider may be slidably and removably received within said notch of said divider; and means for fastening the dividers to the shelving members.

* * * * *